US008695803B2

(12) United States Patent
Blanchette et al.

(10) Patent No.: US 8,695,803 B2
(45) Date of Patent: Apr. 15, 2014

(54) HINGE CONFIGURATION FOR CONTAINER FOR FRANGIBLE ITEMS

(75) Inventors: François Blanchette, Mirabel (CA); Germain Archambault, Saint-Hubert (CA)

(73) Assignee: Pactiv Canada Inc., Scarborough, Ontario (CA)

( * ) Notice: Subject to any disclaimer, the term of this patent is extended or adjusted under 35 U.S.C. 154(b) by 0 days.

(21) Appl. No.: 12/637,092

(22) Filed: Dec. 14, 2009

(65) Prior Publication Data

US 2010/0147729 A1 Jun. 17, 2010

Related U.S. Application Data

(60) Provisional application No. 61/122,650, filed on Dec. 15, 2008.

(51) Int. Cl.
*B65D 85/32* (2006.01)

(52) U.S. Cl.
USPC ..... 206/521.1; 206/521.8

(58) Field of Classification Search
USPC ..... 206/521, 521.1, 521.15, 521.3, 521.6, 206/521.8
See application file for complete search history.

(56) References Cited

U.S. PATENT DOCUMENTS

| | | | | | |
|---|---|---|---|---|---|
| 2,655,303 | A * | 10/1953 | Cox | ..... | 206/521.15 |
| 2,668,652 | A * | 2/1954 | Russell | ..... | 206/521.1 |
| 3,458,108 | A * | 7/1969 | Howarth et al. | ..... | 206/521.1 |
| 3,572,578 | A * | 3/1971 | Rohdin | ..... | 206/521.8 |
| 3,645,436 | A * | 2/1972 | Boyd et al. | ..... | 206/521.1 |
| 3,648,916 | A * | 3/1972 | Commisso | ..... | 206/521.8 |
| D224,518 | S * | 8/1972 | Pearl et al. | ..... | D9/757 |
| 3,712,532 | A * | 1/1973 | Alroy | ..... | 206/521.1 |
| 3,813,027 | A * | 5/1974 | Misdom et al. | ..... | 206/521.1 |
| 4,553,692 | A * | 11/1985 | Padovani | ..... | 206/521.1 |
| 5,494,164 | A * | 2/1996 | Ramirez | ..... | 206/521.8 |
| 6,012,583 | A * | 1/2000 | Ramirez | ..... | 206/521.1 |
| D466,802 | S * | 12/2002 | Davkovski | ..... | D9/757 |
| 7,258,234 | B2 * | 8/2007 | Aardema et al. | ..... | 206/521.1 |
| 7,353,951 | B2 * | 4/2008 | Vovan | ..... | 206/521.8 |
| 2005/0178689 | A1 * | 8/2005 | Aardema et al. | ..... | 206/521 |
| 2005/0189256 | A1 * | 9/2005 | St-Onge | ..... | 206/521.1 |
| 2006/0060493 | A1 * | 3/2006 | Marshall | ..... | 206/521.1 |

* cited by examiner

*Primary Examiner* — Steven A. Reynolds
*Assistant Examiner* — Ernesto Grano
(74) *Attorney, Agent, or Firm* — Baker Botts LLP

(57) ABSTRACT

A container for receiving frangible items comprises a sheet of polymer formed into a base portion having a plurality of item-receiving cavities for supporting frangible items. A cover portion has an item-covering concavity for covering the frangible items. A first hinge portion is positioned between a first longitudinal edge of the base portion and the cover portion for rotating the cover portion onto the base portion to hold the frangible items captive in the item-receiving cavities. The first hinge portion comprises a pair of longitudinal grooves formed into the first hinge portion and extending parallel to the first longitudinal edge of the base portion, with a web defined between the longitudinal grooves, and a hinge-reinforcement wall at least one end of the longitudinal grooves. A fold line is formed in the web and in the hinge-reinforcement wall when the cover portion is rotated onto the base portion.

17 Claims, 4 Drawing Sheets

HINGE CONFIGURATION FOR CONTAINER FOR FRANGIBLE ITEMS

CROSS-REFERENCE TO RELATED APPLICATION

The present application claims priority on U.S. Provisional Patent Application No. 61/122,650, filed on Dec. 15, 2008, and incorporated herein by reference.

FIELD OF THE APPLICATION

The present application relates to containers for receiving frangible objects such as eggs, and to structural components of such containers.

BACKGROUND OF THE ART

Containers of all kinds have been developed for the transportation and sale of frangible food items such as eggs. As eggs are relatively fragile, the egg containers must protect the eggs from the various manipulations involved from the packaging of the eggs to the consumer's refrigerator.

One significant improvement in egg containers is the use of thermoformed plastics as material for the egg containers. Thermoformed plastics are typically transparent, which allows the eggs to be visible, and are relatively inexpensive to produce. As they can inspect the eggs by seeing through the material of the egg container, the consumers do not need to open the egg container, as is the case with cardboard egg containers, for instance. In the case of cardboard boxes, it may occur that the boxes are not closed properly after inspection. This may cause the breakage of eggs if the improperly closed egg container is subsequently manipulated by another consumer.

SUMMARY OF THE APPLICATION

It is therefore an aim of the present invention to provide a container for frangible items that addresses issues associated with the prior art.

Therefore, in accordance with the present application, there is provided a container for receiving frangible items comprising a sheet of polymer formed into: a base portion having a plurality of item-receiving cavities for supporting frangible items; at least one cover portion having at least one item-covering concavity for covering the frangible items; and a first hinge portion between a first longitudinal edge of the base portion and the cover portion for rotating the cover portion onto the base portion to hold the frangible items captive in the item-receiving cavities, the first hinge portion comprising at least a pair of longitudinal grooves formed into the first hinge portion and extending parallel to the first longitudinal edge of the base portion, with a web defined between the longitudinal grooves, and a hinge-reinforcement wall at least one end of the longitudinal grooves, a fold line forming in the web and in the hinge-reinforcement wall when the cover portion is rotated onto the base portion.

Further in accordance with the present application, there is provided a container for receiving frangible items comprising a sheet of polymer formed into: a base portion having a plurality of item-receiving cavities for supporting frangible items; a cover portion having one item-covering concavity for covering the frangible items, the cover portion having a flat top wall and generally flat peripheral walls defining the at least one item-covering concavity; a first hinge between a first longitudinal edge of the base portion and the cover portion for rotating the cover portion onto the base portion in closing the container to hold the frangible items captive in the item-receiving cavities; and a pair of reinforcement beams formed into the concavity of the top cover portion, the reinforcement beams projecting inwardly from the flat top wall and from opposite peripheral walls of the top cover portion into the concavity, the reinforcement beams being centrally positioned along a longitudinal dimension of the container, a gap being defined in the concavity between ends of the reinforcement beams, with the reinforcement beams being seated on a top surface of the base portion when the container is closed.

Still further in accordance with the present application, there is provided a container for receiving frangible items comprising a sheet of polymer formed into: a base portion having a plurality of item-receiving cavities for supporting frangible items, a base peripheral flange defining a periphery of the base portion, and a peripheral hollow curb being positioned inward of the base peripheral flange; a cover portion having one item-covering cavity for covering the frangible items, the cover portion having peripheral walls, and a cover peripheral flange at a bottom of the peripheral walls, to define a periphery of the cover portion; a first hinge between a first longitudinal edge of the base portion and the cover portion for rotating the cover portion onto the base portion in closing the container to hold the frangible items captive in the item-receiving cavities, whereby the base peripheral flange and the cover peripheral flange contact one another, while the peripheral walls of the cover portion and the peripheral hollow curb contact one another, when the container is closed; at least one duct formed into the peripheral hollow curb, the duct being open to an interior of the container when closed; and a ditch formed into at least one of the peripheral flanges for each said duct, and in alignment with the duct to form therewith an air passage between an interior and an exterior of the container.

DESCRIPTION OF THE PREFERRED EMBODIMENTS

Figure 1:
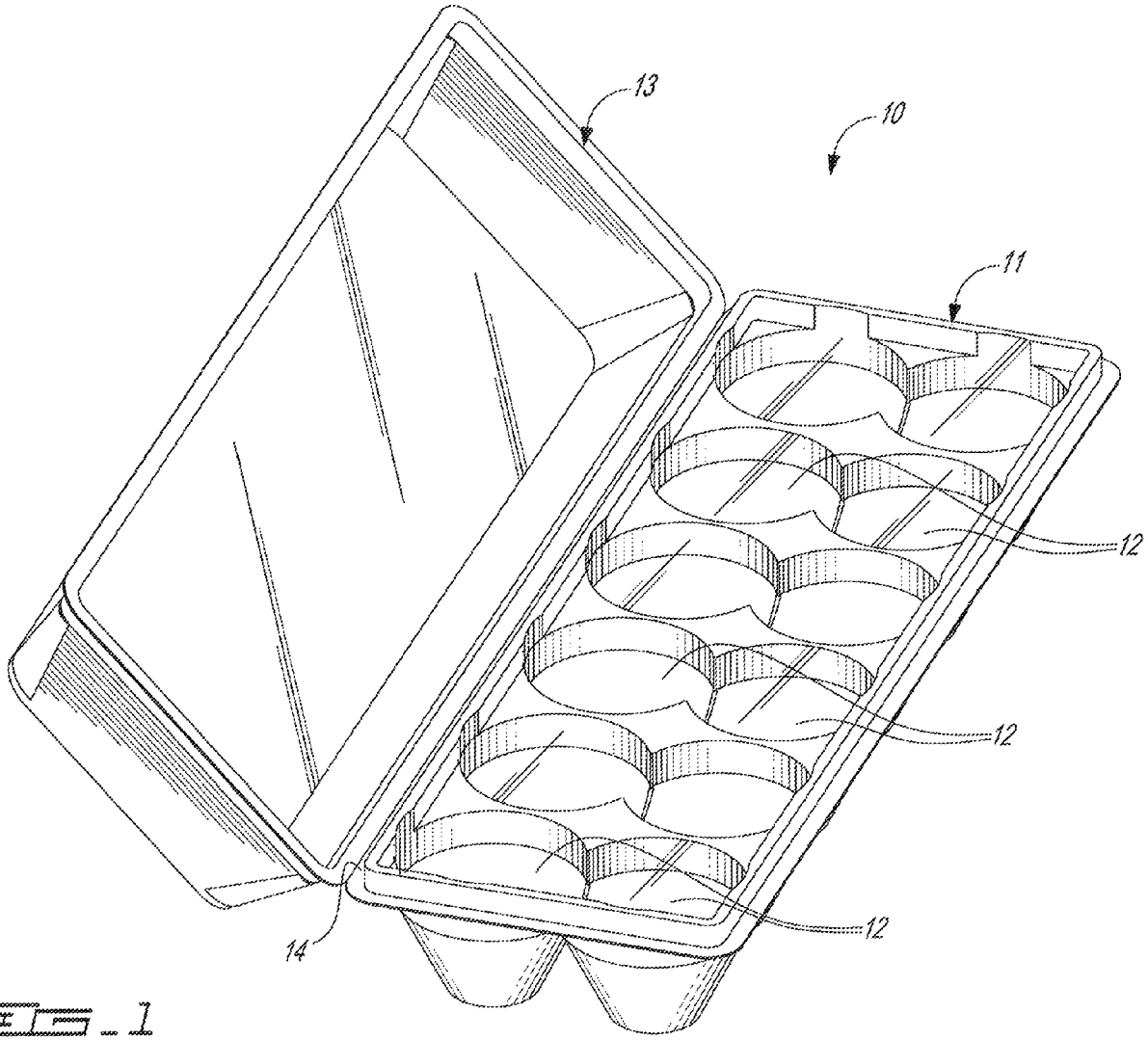
FIG. 1 is a schematic perspective view of a two-fold container for frangible items such as eggs.

Referring to the drawings and more particularly to FIG. 1, a container for frangible items such as eggs is generally shown at 10. The egg containers described hereinafter are preferably made of transparent or translucent plastics, for instance using a thermoforming process or other molding process. Other materials and/or processes may be used as well. The containers described hereinafter may be used to contain eggs or any other frangible items (e.g., tomatoes).

The egg container 10 of FIG. 1 is a two-fold egg container, as it has two portions hinged to one another. The egg container 10 has a base portion 11 having a plurality of egg-receiving cavities 12 (e.g., six, twelve, eighteen, twenty-four, or any other suitable number), with each cavity 12 supporting an egg. A top cover portion 13 is hinged to the base portion 11 by hinge 14, in a longitudinal dimension of the egg container 10. The hinge 14 is generically illustrated in FIG. 1, but may have a specific configuration, as described hereinafter. The top cover portion 13 may or may not have egg cavities to cover a top portion of the eggs supported by the egg-receiving cavities 12. Alternatively, the top cover portion 13 may present a flat top surface as in FIG. 1, with or without strengthening components (e.g., arches, posts). Although not shown, mating connectors or any other suitable type of connector are provided on the periphery of the base portion 11 and top cover portion 13 for interlocking them when the egg container 10 is closed.

Figure 2:
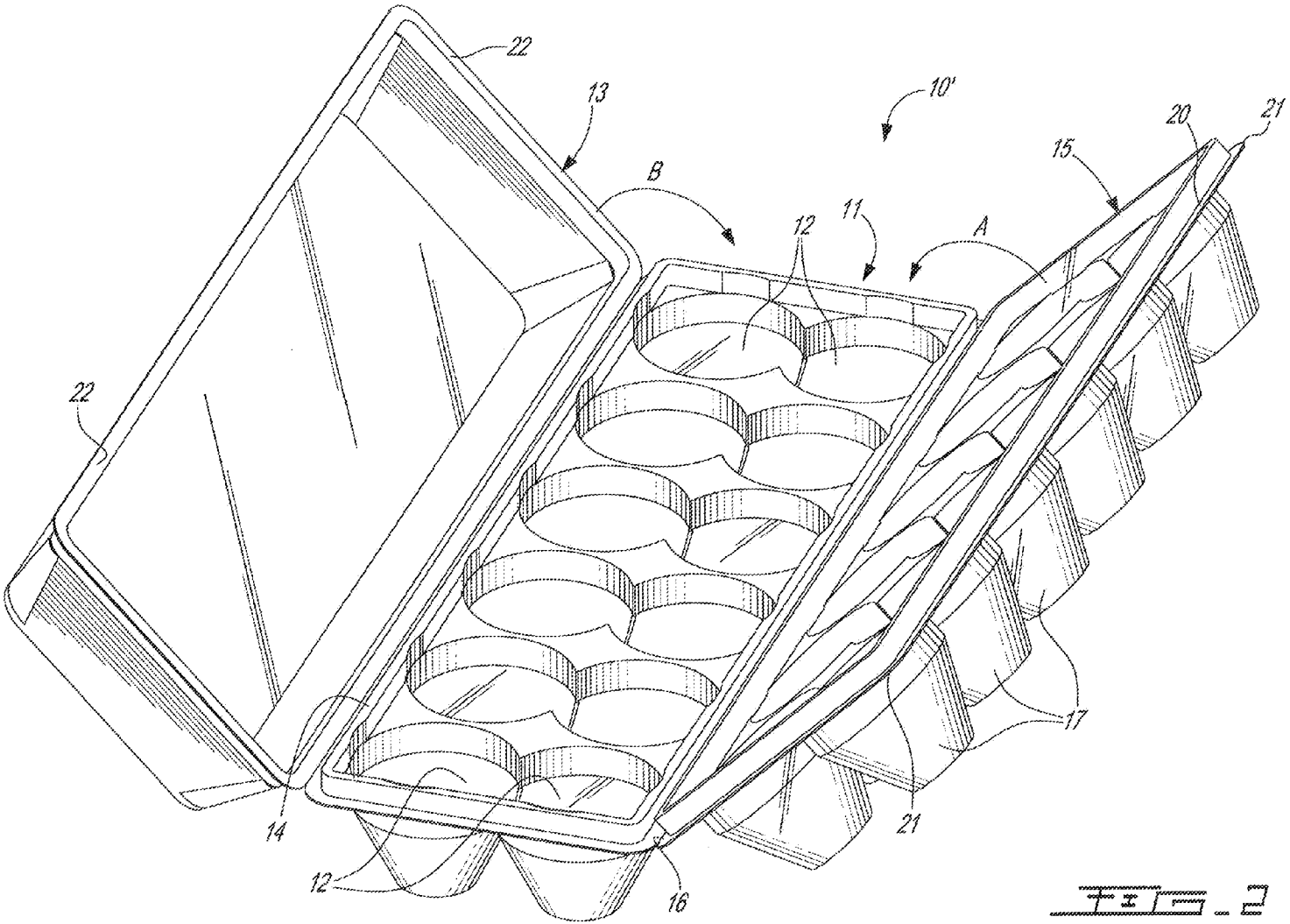
FIG. 2 is a schematic perspective view of a three-fold egg container.

Referring to FIG. 2, a three-fold egg container is generally illustrated at 10'. The egg container 10' is similar to the egg container 10 of FIG. 1, but has an intermediate cover portion 15. The intermediate cover portion 15 is hinged to the base portion 11 by hinge 16, in a longitudinal dimension of the egg container 10'. The hinges 14 and 16 are preferably on opposite edges of the base portion 11. The hinges 14 and/or 16 are generically illustrated in FIG. 2, but may have a specific configuration, as described hereinafter. The intermediate cover portion 15 typically has egg cavities 17 to cover a top portion of the eggs supported by the egg-receiving cavities 12. Although not shown, mating connectors or any other suitable type of connector are provided on the periphery of the top cover portion 13 and the intermediate cover portion 15 for interlocking them when the egg container 10' is closed.

In order to close the egg container 10', the intermediate cover portion 15 is firstly hinged into contact with the base portion 11, as illustrated by arrow A. The top cover portion 13 is then hinged onto the intermediate cover portion 15, as illustrated by arrow B.

The egg containers of the present disclosure may contain any suitable number of egg-receiving cavities. One suitable material for the egg containers of the present application is polyethylene terephthalate (PET). PET has many advantages, as this material can be transparent or opaque and can be produced at high volume and at low cost. Wall thicknesses of PET cases in a contemplated embodiment are of 0.0175 inch in thickness, but other thicknesses as low as 0.012 to as high as 0.022 inch are also contemplated, but this thickness may vary for instance once the sheet is formed into the egg container 10/10'.

Figure 3:
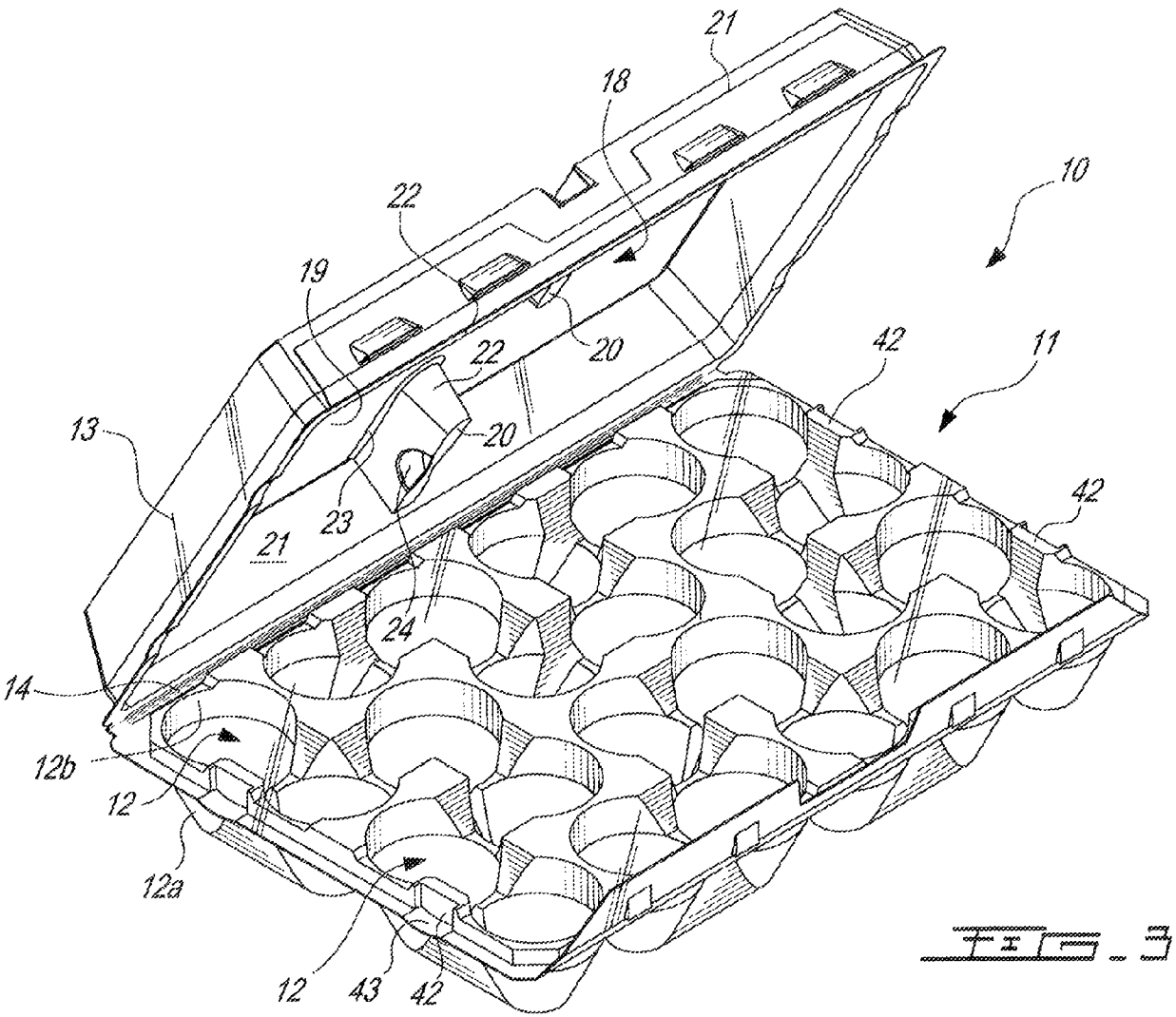
FIG. 3 is a perspective view of an egg container showing a cover portion configuration according to an embodiment of the present disclosure.

In one embodiment, referring to FIG. 3, the top cover portion 13 has one large concavity 18 having a main flat top wall 19 into which center reinforcement beams 20 are formed to rigidify the center of the top cover portion 13. The top cover portion 13 has two of the center reinforcement beams 20, with the beams 20 projecting inwardly from respective peripheral walls 21 of the top cover portion 13. A gap is formed between the inward ends of the center reinforcement beams 20. The center reinforcement beams 20 may have rounded end tips 22 (e.g., frustoconical section), an interiorly projecting ridge 23, and/or ribs 24 (e.g., exteriorly projecting), all of which serve structural functions in strengthening the top cover portion 13. The center reinforcement members 20 sit on the top surface of the base portion 11 when the container 10 is closed.

Figure 4:
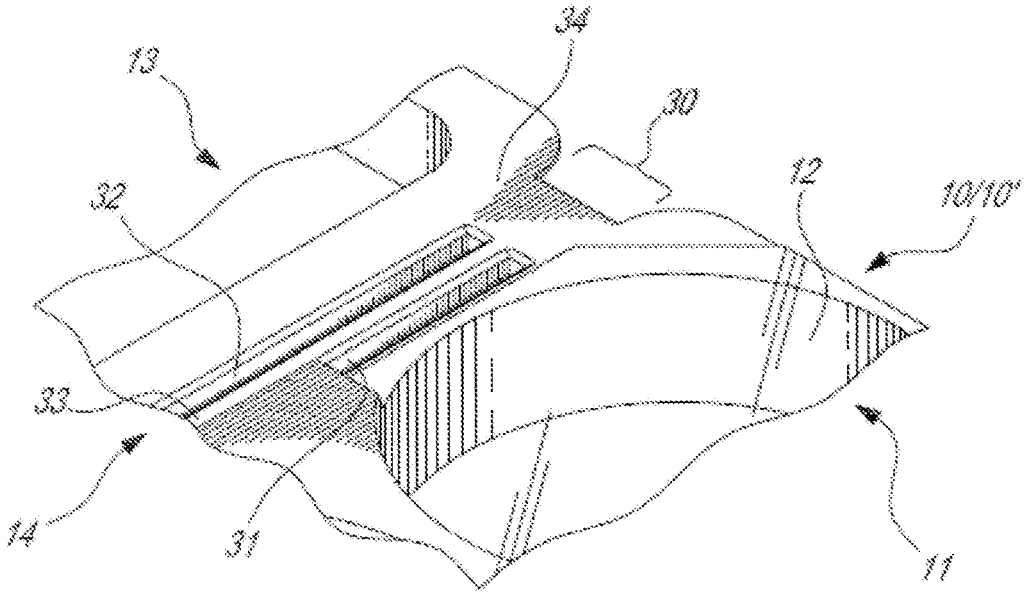
FIG. 4 is an enlarged view of the egg container of FIG. 3, illustrating a hinge configuration in accordance with another embodiment of the present disclosure.

Referring to FIGS. 3 and 4, the hinge 14 is shown having a particular configuration, in the two-fold container 10. The particular configuration may also be used for the hinge 16 in case of a three-fold container 10' (FIG. 2), but is described as being used for hinge 14 in two-fold container 10, for simplicity purposes.

Figure 5:
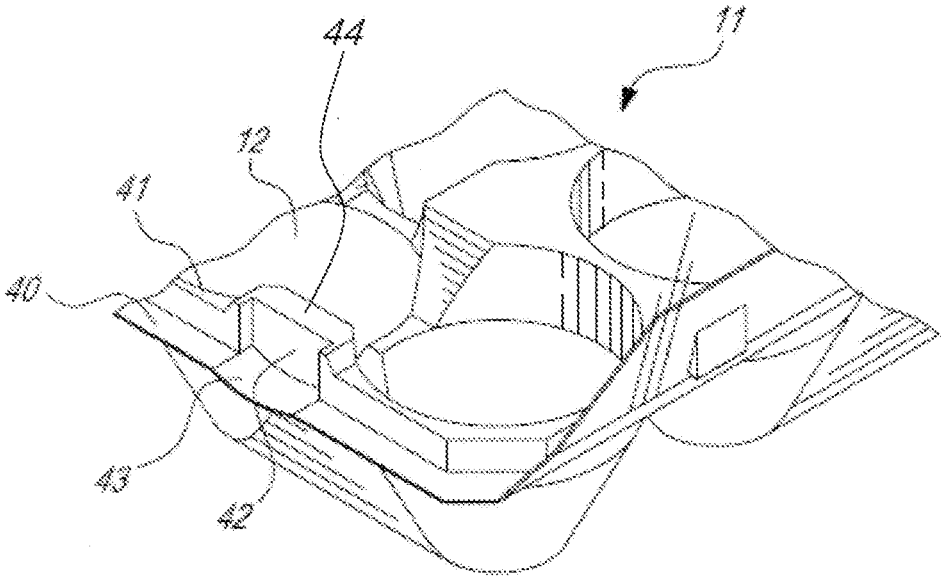
FIG. 5 is an enlarged view of the egg container of FIG. 3, illustrating an aeration unit.

The hinge 14 as shown in FIGS. 4 and 5 is defined in a flat flange section of a width that is permanently deformed when the top cover portion 13 is placed forcibly over the base portion 11 to close the egg container 10. Typically, a fold line is thermoformed where it is desired to have the hinging movement, using precision tooling such as a knife edge. The fold line is a weakness line, as the plastic sheet is thinner thereat. Accordingly, when manipulating an opened container (e.g., before eggs or frangible items are introduced therein), the container 10/10' naturally has a tendency to close.

In order to rigidify the hinge 14, the width of the sheet (FIG. 5) between the base portion 11 and the top cover portion 13 may be increased, to define a hinge portion 30. A pair of longitudinal grooves 31 and 32 are formed in the hinge portion 30, and are separated by a web 33. Flat hinge-reinforcement walls 34 are provided at opposed ends of the longitudinal grooves 31 and 32. There may be a single one of the flat walls 34, at either end of the longitudinal grooves 31 and 32.

The flat walls 34 are molded/formed without a fold line and therefore strengthen the container 10/10' when in an opened and unfolded condition. The walls 34 are preferably substantially flat prior to a fold line being formed, and are preferably of substantially of uniform thickness as well. The container 10/10' is in such opened and unfolded condition prior to its first use. Accordingly, when manipulated, the container 10/10' in the opened and unfolded condition remains generally flat (e.g., when manipulated by automated equipment). The top cover portion 13 does not naturally pivot onto the base portion 11 to close the container 10/10'.

When it is desired to close the container 10/10', the user or automated equipment may forcibly pivot the top cover portion 13 (and middle cover portion 15 if applicable) onto the base portion 11. The presence of the longitudinal grooves 31 and 32 will cause a fold line to form therebetween. The bend or fold line in the PET is thus confined to the web 33 between the two longitudinal grooves 31 and 32, and extends through the flat wall(s) 34. Because the distance in the flat walls 34 is small compared to the length of the grooves 31 and 32, the bend in the PET at the hinge 14 remains focused along the line created in the web 33. The bend is permanent once the egg container 10/10' is closed for the first time.

In one embodiment, the flat wall(s) 34 has (have) a dimension ranging between 0.25 inch to 2.0 inches, along a longitudinal axis of the hinge portion 30. FIG. 5 illustrates more closely the geometry of the two grooves 31,32. The grooves 31 and 32 may be 0.125 inch wide and 0.09 inch deep. The web 33 as contemplated in the shown embodiment may be only 0.03 inch wide. The above dimensions are provided as an example, but any appropriate dimensions are considered.

While a single set of grooves 31,32 are used longitudinally at the hinge between the top cover portion 13 and the base portion 11, a different number of groove sets is also contemplated. The flat walls 34 in the hinge 14 allow the angle to be at around 10 degrees between base portion 11 and top cover portion 13.

Referring to FIG. 5, an aeration unit for the container 10/10' is illustrated. The aeration unit is defined in the base portion 11. The base portion 11 has a peripheral flange 40 surrounding a peripheral hollow curb 41. The item-receiving cavities 12 are positioned inwardly from the peripheral hollow curb 41. The aeration unit defines an air passage for air to enter/exit the container 10/10' when closed. For instance, excess humidity in the container 10/10' may be exhausted through the aeration unit.

The aeration unit features a duct 42 formed into the peripheral hollow curb 41. Accordingly, when the top cover portion 13 is on top of the base portion 11, and thus when the peripheral walls 21 are against the lateral surface of the peripheral hollow curb 41, the duct 42 defines a passage of rectangular section. Other section shapes are considered as well. When the container 10/10' is closed, a peripheral flange of the top cover portion 13, and a peripheral flange of the intermediate cover portion 15, both sit on the peripheral flange 40 of the base portion 11. Accordingly, a ditch 43 is defined in the peripheral flange 41, and merges with the duct 42. The duct 42 and the ditch 43 concurrently form the air passage.

The ditch 43 may alternatively or concurrently be formed into the peripheral flange of the top cover portion 13 in the case of the two-fold container 10. In the case of the three-fold container 10', ditches 43 may be formed in the peripheral flanges of the top cover portion 13 and of the intermediate cover portion.

Referring to FIG. 5, a shoulder 44 may be formed to define an upper edge of the duct 42, to strengthen the hollow curb 41 at the duct 42. As shown in FIG. 3, a plurality of the aeration unit may be provided around the container 10, and the three faces away from the hinge 14.

It is understood that the preceding is merely a detailed description of some examples and embodiments of the present disclosure, and that numerous changes to the disclosed embodiments can be made in accordance with the disclosure made herein without departing from the spirit or scope of the invention. The preceding description, therefore, is not meant to limit the scope of the invention but to provide sufficient disclosure to one of ordinary skill in the art to practice the invention without any undue burden.

The invention claimed is:

1. A container for receiving frangible items, comprising:

a base having:

a plurality of item-receiving cavities each configured to support a frangible item therein, a base peripheral flange defining a periphery of the base and a reference plane, the base peripheral flange having at least one concave portion relative to the reference plane defining a ditch; and a peripheral curb disposed inwardly from and projecting upwardly relative the base peripheral flange, the peripheral curb having an outer surface with an inwardly-offset portion defining a duct therein; and a cover moveable between an opened position and a closed position relative to the base, wherein the ditch of the base peripheral flange is aligned with the duet to define an air passage into the container when the cover is in the closed position.

2. The container of claim 1, wherein the base peripheral flange has a plurality of ditches defined therein, the peripheral curb having a plurality of ducts each corresponding to one of the plurality of ditches in the base peripheral flange.

3. The container of claim 2, wherein the plurality ducts comprise at least one duct proximate a first side of the base and at least one duct proximate an opposing side of the base.

4. The container of claim 1, wherein the cover is hingedly joined to the base and movable between the open position and the closed position relative to the base, the cover having a cover peripheral flange defining a periphery of the cover and having a concave portion relative to the reference plane defining a cover ditch and substantially aligned with the ditch of the tray when in the closed position.

5. The container of claim 4, wherein the base ditch and the cover ditch define an air passage from an exterior of the container to the duct when in the closed position.

6. The container of claim 1, wherein the peripheral curb extends continuously about the periphery.

7. The container of claim 1, further comprising a hinge to hingedly join the cover to the base, the hinge having at least two parallel longitudinal grooves formed therein and a web formed between the at least two longitudinal grooves.

8. The container of claim 7, wherein the ditch is disposed proximate a side of the base perpendicular to the hinge.

9. The container of claim 7, wherein each of the at least two longitudinal grooves have a width wider than a width of the web.

10. The container of claim 7, wherein the base, the cover and the hinge are formed of a single piece.

11. The container of claim 1, wherein the cover further comprises a pair of inline reinforcement beams extending downwardly from the cover toward the base when in the closed position, each beam having a frustoconical portion proximate at least one end of the beam.

12. The container of claim 11, wherein each reinforcement beam has at least one rib projecting downwardly therefrom toward the base when in the closed position.

13. The container of claim 4, wherein at least a portion of the base peripheral flange abuts at least a portion of the cover peripheral flange when the cover is in the closed position.

14. The container of claim 1, wherein the cover comprises a top cover and an intermediate cover, the top cover and the intermediate cover each hingedly joined to the base, the top cover joined to the base on an opposite side from the intermediate cover, the top cover and the intermediate cover each movable between the open position and the closed position relative the base, the intermediate cover disposed between the base and the top cover when the top cover and the intermediate cover are each in the closed position.

15. The container of claim 1, wherein the container is formed from a sheet of polymeric material.

16. The container of claim 15, wherein the polymeric material comprises polyethylene terephthalate.

17. The container of claim 15, wherein the sheet of polymeric material is molded or thermoformed.

* * * * *